United States Patent [19]

Okada

[11] 3,980,221

[45] Sept. 14, 1976

[54] PACKAGE CUSHIONING STRUCTURE

[76] Inventor: Kikuji Okada, 3-11, 5-chome, Asagayakita, Suginami, Tokyo, Japan

[22] Filed: Dec. 27, 1974

[21] Appl. No.: 536,738

[30] Foreign Application Priority Data

Dec. 28, 1973 Japan ..... 48-144655

[52] U.S. Cl. ..... 229/14 C; 229/28 R; 229/49

[51] Int. Cl.[2] ..... B65D 5/50; F04B 2/28

[58] Field of Search ..... 229/14 C, 40, 29; 206/521, 453, 454, 448

[56] References Cited

UNITED STATES PATENTS

| | | | |
|---|---|---|---|
| 1,077,322 | 11/1913 | Ward | 229/28 R |
| 1,821,692 | 9/1931 | Copeland | 229/14 C |
| 2,784,897 | 3/1957 | Braunstein | 229/28 R |
| 2,979,248 | 4/1961 | Washington | 229/14 C |
| 2,984,399 | 5/1961 | Gaulke | 229/14 C |
| 3,055,494 | 9/1962 | Hepp | 229/28 R X |
| 3,221,973 | 12/1965 | Kalbrener | 229/14 C |
| 3,565,323 | 2/1971 | Katzenmeyer | 229/28 R |
| 3,793,791 | 10/1971 | Wootem | 229/49 |

*Primary Examiner*—Davis T. Moorhead
*Attorney, Agent, or Firm*—Stewart and Kolasch, Ltd.

[57] ABSTRACT

A package cushioning structure to be used in containers or the like to protect the edges and corners of articles against shock and damage the package cushioning structure, which is made at low material and fabrication cost to increase the load carrying and cushioning capacities of containers and can readily be disposed of after use.

14 Claims, 13 Drawing Figures

PACKAGE CUSHIONING STRUCTURE

The present invention relates to a package cushioning structure to be used in containers or the like to protect the edges and corners of articles against shock and damage. More particularly, the present invention concerns a package cushioning structure fabricated by superposing a plurality of spacer fins of an outer board which itself is bent to a given angle into two face portions with a plurality of matching spacer fins of an inner board which itself consists of two face portions substantially parallel to those of the outer board, with the latter fins being aslant at a given angle to the outer board, and by gluing or otherwise joining the superposed fins together back to back to provide an integral structure.

Conventional package cushioning structures are usually made of plastic foams, such as styrol foam, or of thick laminated corrugated boards. The cushioning structures of plastic foams have problems of high material and molding cost and difficulty in disposal of used dunnages. The laminated-corrugated-board dunnages have a common drawback of limited load carrying capacity.

The present invention eliminates the foregoing disadvantages by offering improvements over the prior art structures. It is thus an object of the present invention to provide a package cushioning structure which is made at low material and fabrication cost, has great load carrying and cushioning capacities, and is easily disposed of after use.

Another object of the invention is to provide a package cushioning structure which can be easily and quickly made from outer and inner boards, either or both of the boards consisting of paperboard, cardboard, pasteboard, or corrugated board.

Still another object of the present invention is to provide a package cushioning structure in which the angle at which two face portions of the outer board and/or the inner board meet may be right, acute, or obtuse, the choice depending upon the angle of the edges and/or corners of the article or object to be dunnaged.

Yet another object of the present invention is to provide a package cushioning structure in which the inner and outer boards differ in physical strength so that either board is imparted with greater cushioning quality than the other.

A further object of the invention is to provide a package cushioning structure in which the spacer fins of the inner or outer board are of H, V, U or other suitably chosen shape in cross section and are symmetrically adhered back to back to the corresponding fins of the other board.

These and other objects and advantages of the present invention will become apparent from the following description taken in connection with the accompanying drawings, wherein.

Figure 1:
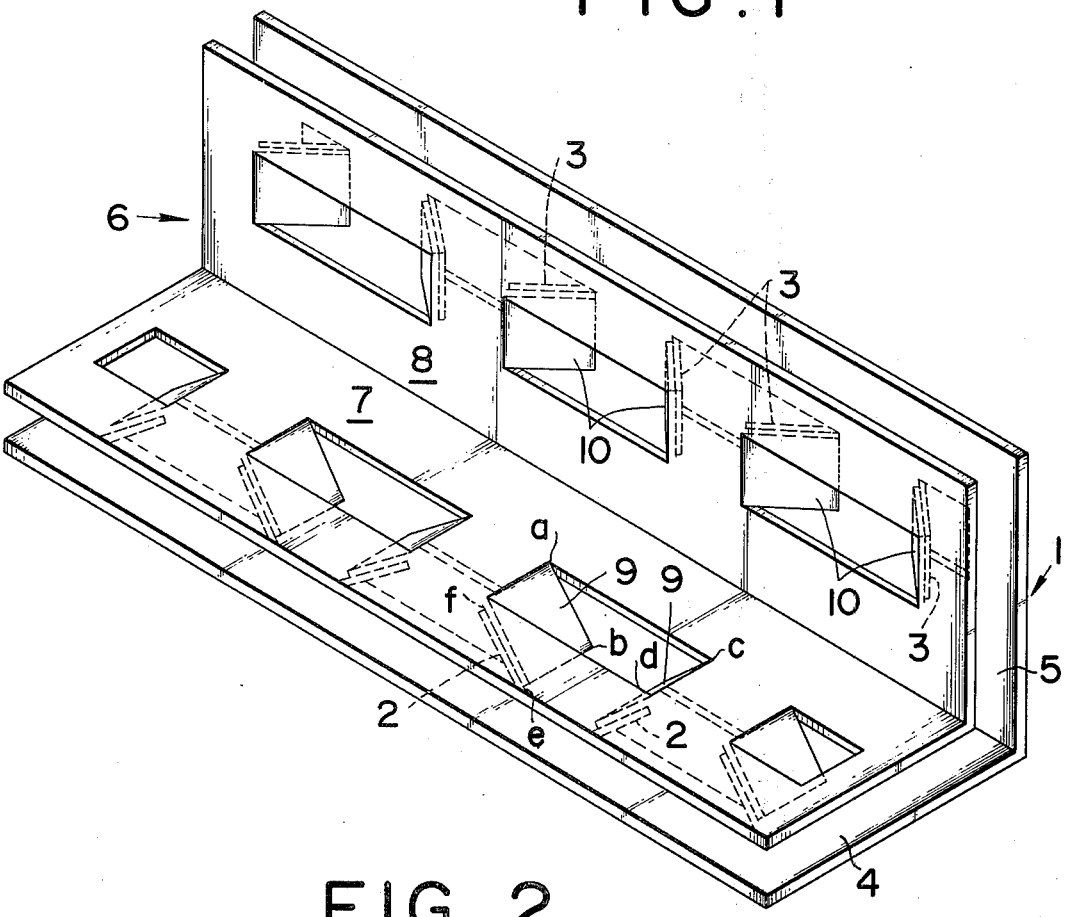
FIG. 1 is a perspective view of the first embodiment of a package cushioning structure according to the invention.
Figure 2:
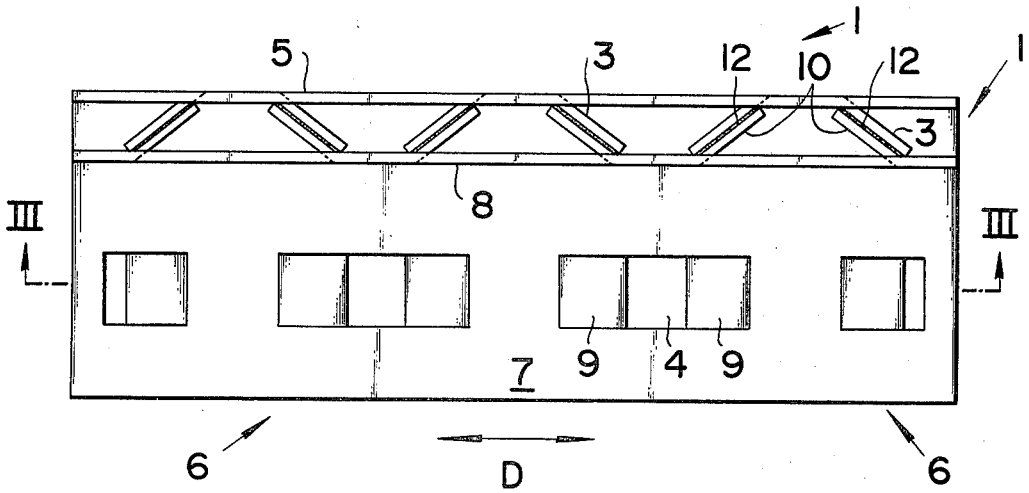
FIG. 2 is a plan view thereof.
Figure 3:
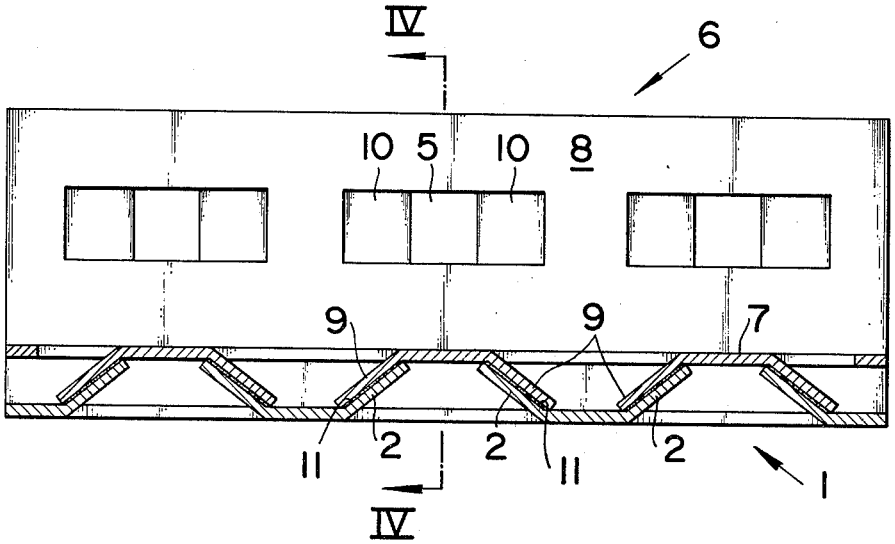
FIG. 3 is a partly sectional view taken along the line III—III of FIG. 2.
Figure 4:
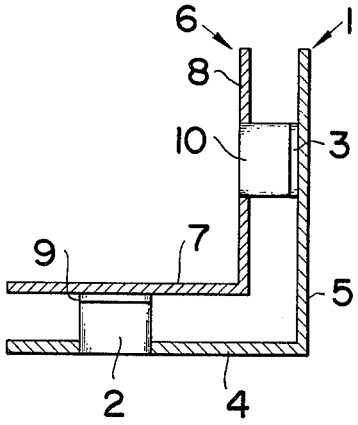
FIG. 4 is a cross sectional view taken along the line IV—IV of FIG. 3.
Figure 5:
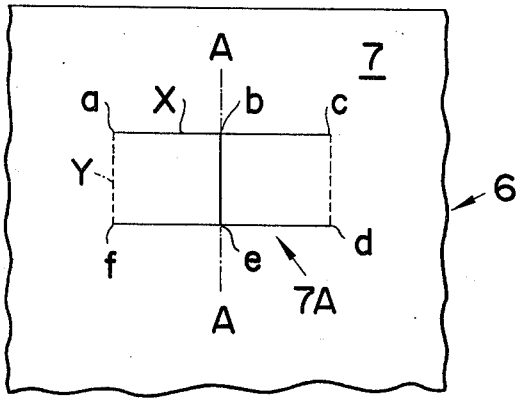
FIG. 5 is a view explanatory of the manner in which spacer fins of the package cushioning structure are formed.
Figure 6:
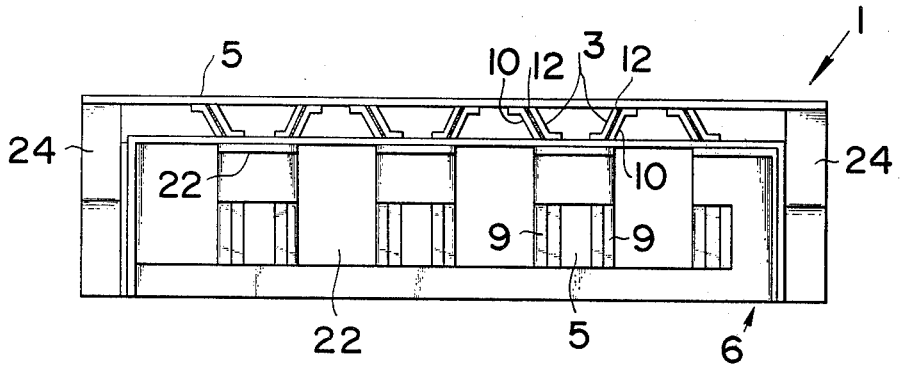
FIG. 6 is a plan view of the second embodiment of the invention.
Figure 7:
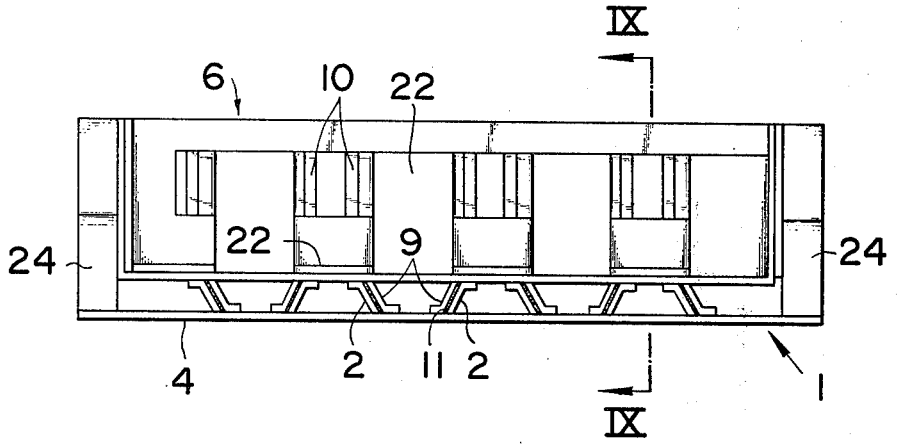
FIG. 7 is a front view of the second embodiment.
Figure 8:
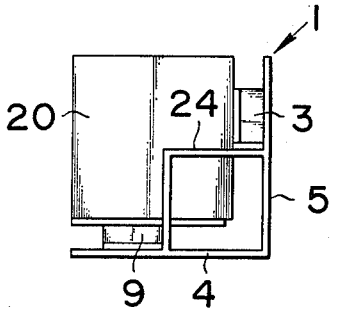
FIG. 8 is a side view.
Figure 9:
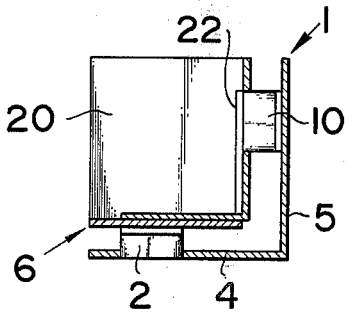
FIG. 9 is a cross sectional view taken along the line IX—IX of FIG. 7.

Referring now to FIGS. 1 through 5, there is shown an embodiment of the invention as based on an outer board 1 of cardboard, corrugated board or the like. As shown best in FIG. 4, the outer board consists of a horizontal face portion 4 and a vertical face portion 5 substantially at right angles to each other. These portions 4, 5 are formed with spacer fins 2, 3, respectively. Numeral 6 indicates an inner board, which may or may not be made of the same material as the outer board 1 according to the necessity. The inner board consists of face portions 7, 8 corresponding to, and arranged in parallel to, the horizontal and vertical face portions 4, 5 of the outer board. The portions 7, 8 have spacer fins 9, 10 similar in shape to the fins 2, 3, respectively. The method of forming these fins 2, 3, 9, 10 will now be explained with particular reference to FIG. 5 which shows a fragment of the inner board 6 by way of example. A fragmentary area 7A of the face portion 7 is cut open along two U lines *a-b-e-f* and *c-b-e-d* indicated by full lines X, overlapping bottom to bottom, or at the center line A—A, and the flaps thus obtained are folded obliquely downward from end lines *a-f* and *c-d* indicated by broken lines Y to provide the fins 9, 10. The fins are then joined to the corresponding spacer fins 2, 3 of the outer board by means of adhesive layers 11, 12. In order to keep the outer and inner boards 1, 6 in a uniformly spaced relation throughout, their fins are slanted at a given angle to the outer board. If both boards are to be made of corrugated board, it is desirable by reason of strength that the cross direction of corrugated board are parallel to the directions D in FIG. 2.

In another embodiment of the invention shown in FIGS. 6 to 9, numerals 1 through 11 designate parts like or corresponding to those of the embodiment already described. Here, corner pads 20 are held inwardly of the inner board 6, and cushioning strips 22 are attached to, or supported by, the inner side of the same board. End spacers 24 are provided on both ends of the outer board 1. Instead of forming the end spacers in one piece, square paperboard tubes, articles formed by corrugated board or laminated corrugation board of a suitable width may be glued to the both ends.

Figure 10:
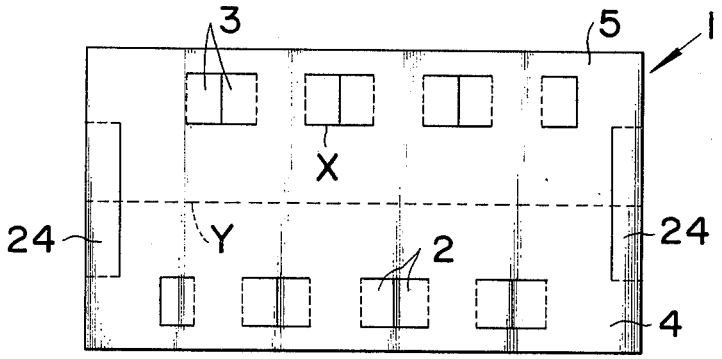
FIGS. 10 and 11 are views explanatory of the manner in which outer inner boards, respectively, of the second embodiment are assembled.
Figure 11:
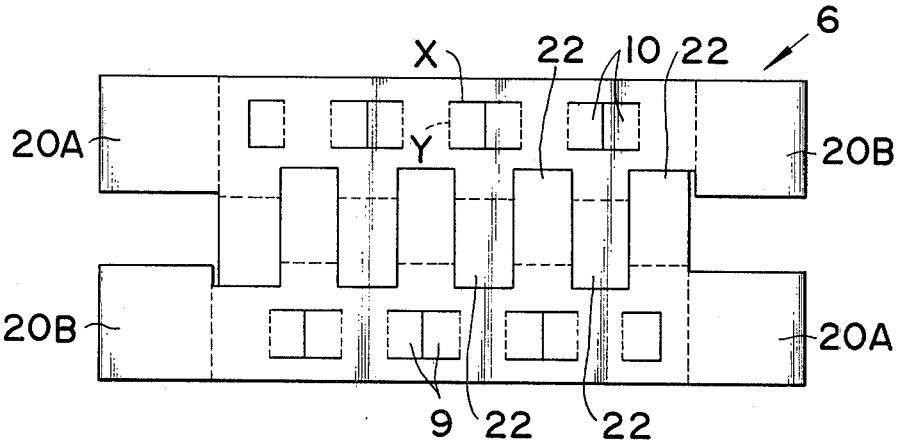

The second embodiment just described above is fabricated in the following way. As shown in FIGS. 10 and 11, an outer board 1 and an inner board 6, both of corrugated board, are prepared. The full lines indicate the lines X along which the boards have been cut off, and the broken lines indicate the lines Y along which the boards are to be folded down. With end spacers 24 folded back in between, the outer and inner boards 1, 6 are held apart in parallel, making certain that neither end spacer is at a point coinciding with any cut-off line X. Next, the spacer fins 2, 3 of the outer board 1 are folded aslant toward the inner board 6, and the fins 9, 10 of the inner board toward the outer board. The fins 2, 3 and 9, 10 are superposed back to back and glued together at 11, 12. Then the cushioning strips 22 are folded outwardly and the outer board 1 is bent to an L shape in cross section so that the strips are glued to the outer board or are supported by the folding parts indicated by broken lines. The corner pads 20A and then 20B are bent inwardly and are glued or otherwise united together. It is possible, as an alternative, to slit the pads 20A and provide the matching pads 20B with tongues adapted to fit into the slits. Lastly, the end spacers 24 are folded back to complete the assembling of the package cushioning structure.

Figure 12:
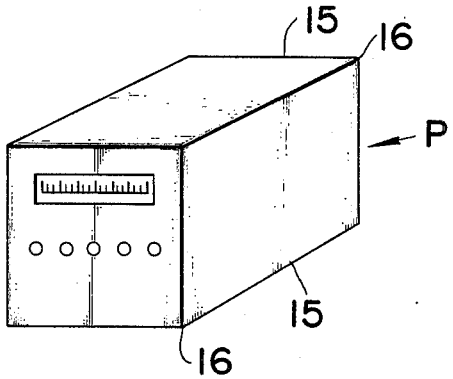
FIG. 12 is a perspective view of an object to be protected by the package cushioning structure of the invention.

FIG. 12 shows a typical article or object P to be dunnaged in accordance with the present invention. Numeral 15 indicates the edges and 16 indicates the corners of the object to be protected by the package cushioning structure of the invention. The corners 16 are suitably protected by means of dunnage units, for example, obtained by cutting the second embodiment of the invention across its length into two units.

By way of illustration the two embodiments of the invention have been described as having one row of spacer fins on each portion, horizontal or vertical, of the outer board. Actually each portion may have two or more rows of fins instead.

Also it is possible to form the spacer fins only on either outer or inner board and glue or weld the fins to the other board. The dunnage thus obtained will have excellent cushioning effect, particularly for lighweight articles or objects.

Figure 13:
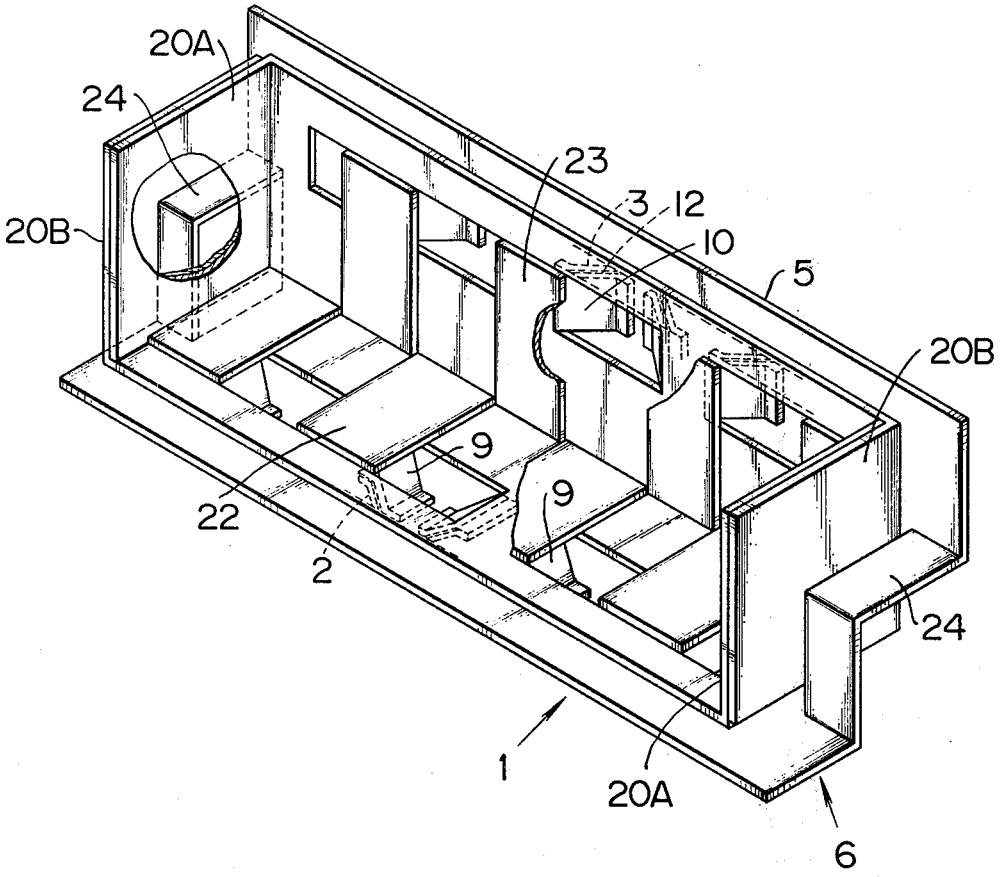
FIG. 13 is a perspective view of the second embodiment of the present invention as shown in FIGS. 6 to 11.

FIG. 13 shows, in a perspective view, the embodiment of FIGS. 6 to 11. Thus, FIG. 13 more explicitly shows the use of cushioning strips 22, end spacers 24 and corner pads 20A and 20B.

While the invention has been described in its preferred embodiments, it is to be understood that various modifications may be made without departing from the spirit of the invention as hereinafter claimed.

What is claimed is:

1. A package cushioning structure comprising an outer backing board bent at a given angle into two face portions and containing a plurality of spacer fins, and an inner contact board bent into two face portions which are disposed substantially parallel to those of the outer board, said inner contact board containing a plurality of matching spacer fins, said fins of the inner and outer boards being folded aslant at a given angle with respect to said boards, said fins being superimposed and joined together back to back to provide an integral structure.

2. The package cushioning structure according to claim 1 wherein the outer board and/or the inner board is made of paperboard, cardboard, or corrugated board.

3. The package cushioning structure according to claim 1 wherein the angle at which the two face portions of the outer board and/or the inner board meet may be right angles, acute angles, or obtuse angles, the choice depending upon the angle of the edges and/or corners of the article or object to be dunnaged.

4. The package cushioning structure according to claim 1 wherein the inner and outer boards differ in physical strength so that either board is imparted with greater cushioning quality than the other.

5. A package cushioning structure according to claim 1 wherein the spacer fins of the inner or outer board are of H shape in cross section.

6. The package cushioning structure according to claim 1, wherein the spacer fins of the inner or outer boards are of a V shape in cross section.

7. The package cushioning structure according to claim 1, wherein the spacer fins of the inner or outer boards are of a U shape in cross section.

8. The package cushioning structure of claim 1, wherein the opposite spaces of corresponding faces fins are joined together.

9. The package cushioning structure of claim 1, wherein end spacers are disposed at the ends of the two face portions of the outer backing board, each of said end spacers having two free sides and two sides which are integral with said two face portions, said end spacers being folded along the middle line thereof.

10. The package cushioning structure of claim 9, wherein corner pads are associated with said end spacers.

11. A package cushioning structure comprising an outer backing board bent at a given angle into two face portions and containing a plurality of spacer fins, and an inner contact member having two face portions which are disposed substantially parallel to those of the outer backing board, each face of said inner contact member having end members on both sides thereof which extend at an angle from said face portion and overlap with corresponding end members of the other face portion, said inner contact member containing a plurality of matching spacer fins, said fins of the inner contact member and outer backing board being folded aslant at a given angle with respect to said inner contact member and outer backing board, said fins being superimposed and joined together back to back to provide an integral structure.

12. The package cushioning structure of claim 11, wherein the corresponding overlapping end members are joined together to provide an integral structure.

13. The package cushioning structure of claim 11, wherein cushioning strips are provided which extend at an angle from each of said face portions of the inner contact member intermediate said end members, said cushioning strips overlapping and reinforcing the other face portion of said inner contact member.

14. The package cushioning structure of claim 11, wherein end spacers are disposed at the ends of the two face portions of the outer backing board, each of said end spacers having two free sides and two sides which are integral with said two face portions, said end spacers being folded along the middle line thereof.

* * * * *